US011272747B2

(12) United States Patent
Bulger

(10) Patent No.: US 11,272,747 B2
(45) Date of Patent: Mar. 15, 2022

(54) HAND WARMER WITH VIEWING WINDOW

(71) Applicant: Hunter's Edge, LLC, Bainbridge, GA (US)

(72) Inventor: James A. Bulger, Bainbridge, GA (US)

(73) Assignee: Hunter's Edge, LLC, Bainbridge, GA (US)

( * ) Notice: Subject to any disclaimer, the term of this patent is extended or adjusted under 35 U.S.C. 154(b) by 163 days.

(21) Appl. No.: 16/848,261

(22) Filed: Apr. 14, 2020

(65) Prior Publication Data

US 2021/0100295 A1 Apr. 8, 2021

Related U.S. Application Data

(60) Provisional application No. 62/912,075, filed on Oct. 8, 2019.

(51) Int. Cl.
*A41D 13/08* (2006.01)
*A41D 13/005* (2006.01)

(52) U.S. Cl.
CPC ..... *A41D 13/0058* (2013.01); *A41D 13/081* (2013.01)

(58) Field of Classification Search
CPC .... A41D 1/005; A41D 1/002; A41D 13/0058; A41D 13/081
See application file for complete search history.

(56) References Cited

U.S. PATENT DOCUMENTS

| | | | | |
|---|---|---|---|---|
| 5,499,401 | A * | 3/1996 | Heinmiller | A41D 13/081 2/208 |
| 8,615,814 | B1 * | 12/2013 | Hawkins | A41D 13/081 2/66 |
| 8,756,716 | B2 * | 6/2014 | Jordan | A41D 1/005 2/247 |
| 9,320,309 | B2 * | 4/2016 | Morris | A41D 19/002 |
| 2006/0248624 | A1 * | 11/2006 | Pieczynski | A41D 13/081 2/16 |
| 2010/0299800 | A1 * | 12/2010 | Jackson, Jr. | A41D 13/081 2/69 |
| 2016/0095364 | A1 * | 4/2016 | Kafka | A41D 13/081 2/16 |
| 2017/0065872 | A1 * | 3/2017 | Kelley | A63B 71/0622 |

* cited by examiner

*Primary Examiner* — Tajash D Patel
(74) *Attorney, Agent, or Firm* — Lewis, Brisbois, Bisgaard & Smith LLP; Jeffrey F. Yee

(57) ABSTRACT

A hand warmer with viewing window includes an insulated hand warmer with a viewing window, a protective cover flap, and a sliding viewing surface of polycarbonate or acrylic plastic the user opens to remove prevent condensation.

17 Claims, 12 Drawing Sheets

HAND WARMER WITH VIEWING WINDOW

CROSS REFERENCE TO RELATED APPLICATIONS

This application which claims priority to, and benefit from, of application Ser. No. 62/912,075, filed Oct. 8, 2019, entitled "Hand Warmer with Viewing Window", which is incorporated by reference in its entirety for all purposes.

FIELD

The present disclosure relates to hand warmers, and, particularly, an insulated hand warmer with a removable and selectably positionable viewing window for viewing electronic media devices. The hand warmer is designed to be used while viewing cell phones or electronic devises through a preformed window of polycarbonate or acrylic plastic. The clear window prevents the user from exposing their hands or the device to cold weather in order to read or compose a text, read or compose an email, watch a video, play games, or make a phone call.

BACKGROUND

Hand warmers such as hand muffs and pockets on winter clothing are commonly used in cold weather to keep an individual's hands warm and otherwise protected from the cold temperatures and other inclement weather conditions. Hand-held media devices, such as smartphones, tablets, and electronic wearables are frequently used outdoors. The user, however, may limit the outdoor usage of the device in cold or other inclement weather to minimize exposing the device to cold or moisture or to protect the user's hands from such conditions.

A need developed to allow a user to view a hand-held device during inclement weather conditions while keeping his or her hands warm. Current insulated hand warmers may have a viewing panel formed of solid transparent material or screen mesh material. There may be an existing problem with condensation and provides the alternative of a screen mesh material as a solution. Current hand warmers mat not provide a means for solving the condensation and fogging issue while using a solid transparent material.

Thus, an ongoing need exists to solve the problem of heat accumulation within the field of hand warmers with a viewing window. If too much heat is being trapped inside the hand warming muff causing fog or condensation to accumulate onto the surface of the polycarbonate or acrylic plastic.

SUMMARY

The hand warmer with viewing window device of the present disclosure is an insulated hand warmer, designed to be used while viewing cell phones or electronic devises through a preformed window of polycarbonate or acrylic plastic. The clear window prevents the user from exposing their hands or the devise to cold weather in order to read or compose a text, read or compose an email, watch a video, play games, or make a phone call. The user eliminates condensation by opening the viewing window.

A first object of the present disclosure provides a combination insulated hand warmer and means for viewing cell phones or electronic devices through a window. A second object of the invention provides a hand warmer with a viewing window that slides open to reduce or eliminate condensation. Those skilled in the art will recognize these and other objects within the scope of the invention disclosed herein.

DETAILED DESCRIPTION

FIGS. 1-12 and the following description depict specific examples of the invention to teach those skilled in the art how to make and use the invention. For the purpose of teaching inventive principles, some conventional aspects have been simplified or omitted. Those skilled in the art will appreciate variations from these embodiments that fall within the scope of the invention. Those skilled in the art will appreciate that the features described below can be combined in various ways to form multiple embodiments and variations of the invention. As a result, the invention is not limited to the specific embodiments described below, but only by the claims and their equivalents.

The hand warming and media protective hand muff disclosed comprises an insulated hand warmer. The hand warmer is designed to be used while viewing cell phones or electronic devices through a selectably positional window of polycarbonate or acrylic plastic. The clear window prevents the user from exposing their hands or the devise to cold weather in order to read or compose a text, read or compose an email, watch a video, play games, or make a phone call.

A user unzips the outer cover to expose the viewing window. Place cell phone or other electronic devise inside the hand warmer underneath the viewing window made of polycarbonate or acrylic. If too much heat is being trapped inside the hand warming muff causing fog or condensation to accumulate onto the surface of the polycarbonate or acrylic plastic, the user opens the window a little by sliding it to allow the opening of an orifice. After the condensation is gone, the user slides the window back into place.

The orifice is sized to fit the window. The orifice may have a stabilizer portion generally around the orifice. The stabilizer reduces the likelihood that the window will rest on the hands of a user when in use. This may reduce chafing or rubbing of the window on the hands of a user, and make the hand warmer more comfortable to use.

In an exemplary embodiment the hand warmer includes an ultra-soft brushed tricot camouflage with curved form-fit outer shell, 150-grams of 3-M Thinsulate insulation protects hands from bitter cold, and fleece cuff extensions to seal in warmth. The viewing area of the hand warmer includes preformed acrylic or polycarbonate viewing window, and a screen flap or cover with fastener to selectively open and close the cover.

The combined garment of the hand warmer with viewing window has additional features including adjustable waist webbing strap with snap closure, high-loft fleece lining, zippered exterior accessory compartment, and elastic strip holds electronic device in place. The hand warmer with viewing window is ideal for tree stand or ground blind hunting and designed as one size to fit all users.

Figure 1:
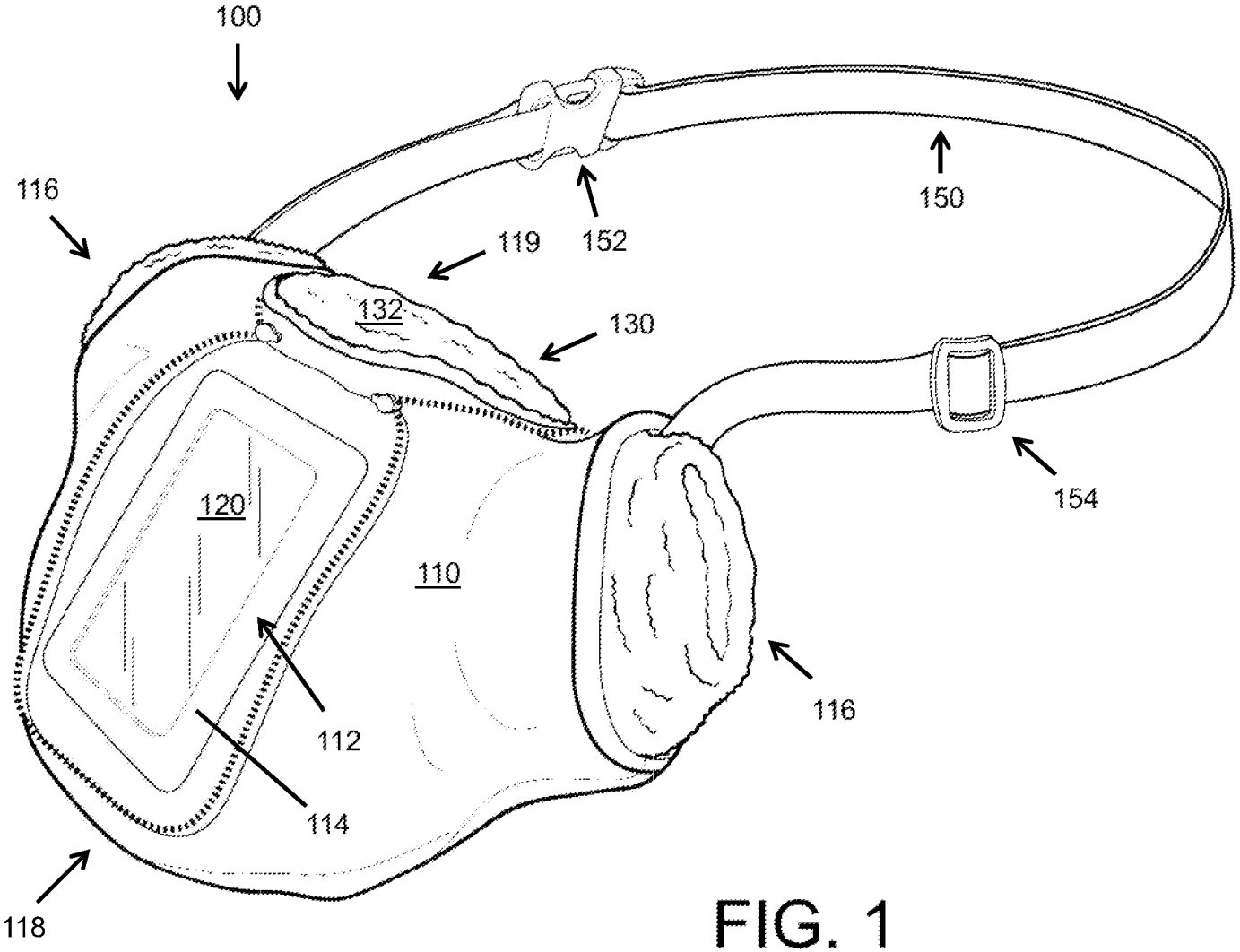
FIG. 1 illustrates a perspective view of a hand warmer with a cover in the open position, according to an example.

FIG. 1 illustrates an example hand warmer 100. Hand warmer 100 may include a body portion 110, window 120, and belt 150. Belt 150 may include a coupler 152, and adjustor 154. Coupler 152 may be configured to allow the belt to selectively couple and uncouple around a user. Adjustor 154 may be configured to selectively lengthen belt 150 to allow for loosening to tightening the belt 150 generally around the waist area of a user.

Figure 9B:
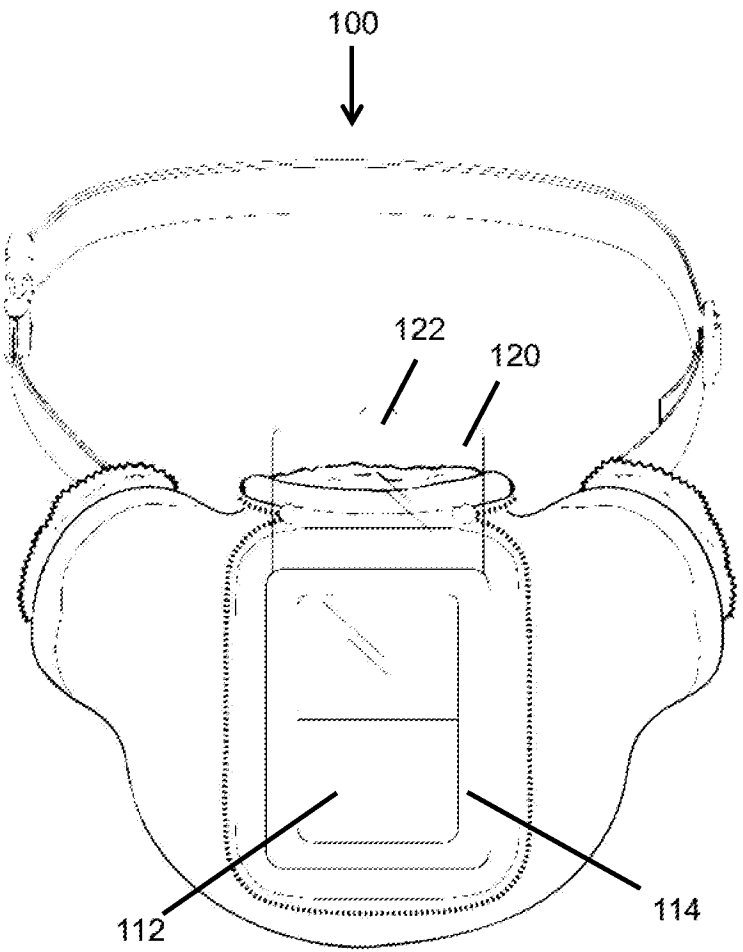
FIG. 9B illustrates a front view of a hand warmer showing the window in the open position, according to an example.
Figure 9A:
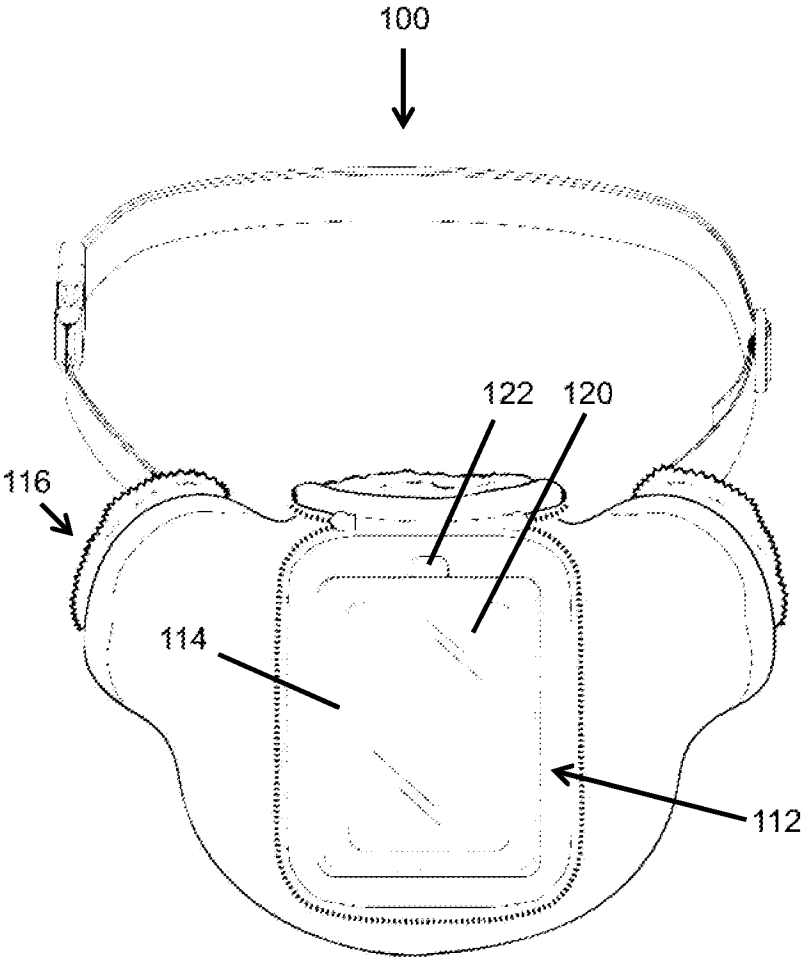
FIG. 9A illustrates a front view of a hand warmer showing the window in the closed position, according to an example.

Window 120 may be made from polycarbonate or acrylic plastic, or other generally transparent, generally rigid material. Other materials may be used, which are generally transparent. Window 120 may also be anti-fog coated to reduce condensation on the window 120 when in use. Window 120 may also include a tab 122, as shown in FIGS. 9A and 9B to allow a user to selectably position the window 120 to partially open orifice 112 to allow fog and condensation reduction. Window 120 may also be removed and replaced with a new window, as needed.

Body portion 110 may include an orifice 112, stabilizer portion 114, and openings 116. Orifice 112 may be configured in size along with window 120 to provide a protected viewing area for a user to manipulate a user device located in the interior of body portion 110.

Stabilizer portion 114 may be configured generally around orifice 112, and be configured to slidably receive window 120. Stabilizer portion 114 may provide stability for body portion 110 such that when in use by a user, window 120, stabilizer portion 114, and body portion 110 generally do not touch or rest on the hands of a user. This configuration may make the hand warmer 100 more comfortable when in user, and may reduce chafing and rubbing of the hand warmer 100 on the hands or other portion of a user.

Body portion 110 may also include a form stabilizer portion 118, located generally in the top portion 119, and/or bottom portion 117 (see FIGS. 11 and 12) of body portion 110. Form stabilizer portion 118 comprises generally rigid material in a dual wedge shape, with generally concave edges, to create space between the front and back portions of body portion 110.

Form stabilizer portion 118 may provide stability for body portion 110 such that when in use by a user, window 120, stabilizer portion 114, and body portion 110 generally do not touch or rest on the hands of a user. This configuration may make the hand warmer 100 more comfortable when in user, and may reduce chafing and rubbing of the hand warmer 100 on the hands or other portion of a user.

Openings 116 are sized to allow the hands of a user to extend therethrough and into the inner portion of body 110. A shown, openings my include a fleece lining and elastic to further keep the hands and other portions of the user warm when using the hand warmer 100.

Figure 2:
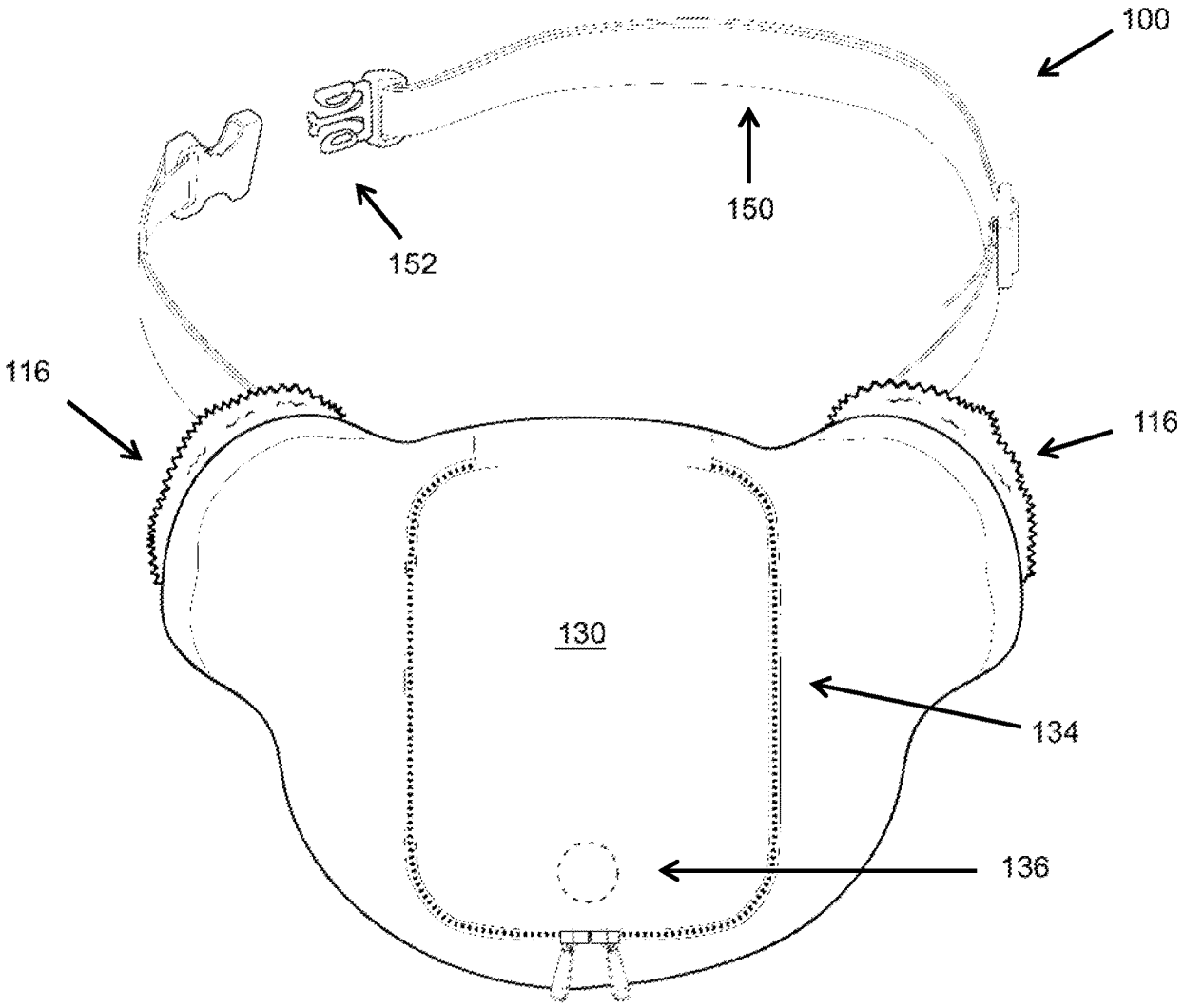
FIG. 2 illustrates a front view of a hand warmer with a cover in the closed position, according to an example.

Body 110 may also include cover 130, which may be selectably positional over orifice 112 and window 120. Cover 130 may be fastened in a closed position via fastener 134. FIG. 1 shows cover 130 in the open position. FIG. 2 shows cover 130 in the closed position.

Cover 130 may also include a fleece or insulation portion 132, which may enhance the warming of the hands of a user when the hands or other portion of the user are within the interior of body portion 110, when cover 130 is in the closed position.

FIG. 2 shows a front view of a hand warmer 100 with cover 130 in the closed position, according to one embodiment. In this embodiment, fastener 134 is a slide or zipper-type fastener. This may enhance the warming of the warmer 100 because it may let in less outside air to the interior of body 110. Other fastener types may be sued, based on the design characteristics of the warmer.

Cover 130 may also include a cover securing system, a portion of which is coupler 136. Coupler 136 may be a magnet. The securing system may also include a corresponding magnet on the backside of body 110, such that the magnets 136 will couple to secure the cover 130 in the open position. This will allow a user to use an electronic device in the interior of the body 110 without the cover 130 obstructing the view or getting in the way.

Figure 3:
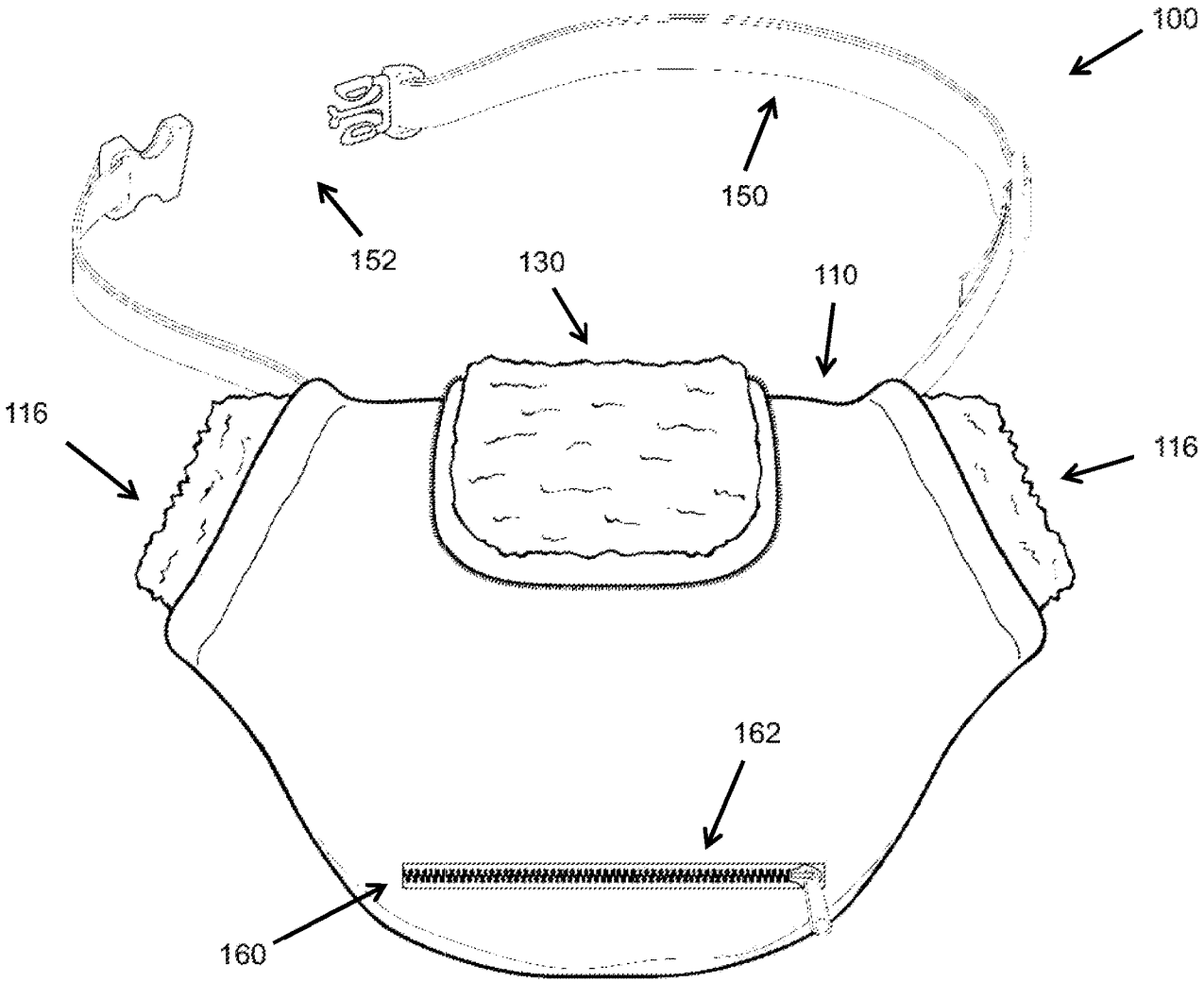
FIG. 3 illustrates a back view of a hand warmer with a cover in the open position, according to an example.

FIG. 3 shows the backside of body 110, which includes a compartment 160 partially defined by closure 162. In this embodiment, compartment 160 is in the closed position. Further, cover 130 is secured in the open position by securing system and coupler 136. Compartment 160 may be used by the user to store car keys, a battery charger for the electronic device, and other items. The items may then be secured inside the compartment by closure 162. Closure may be a slide fastener, as shown, or other closure structure or system.

Figure 4:
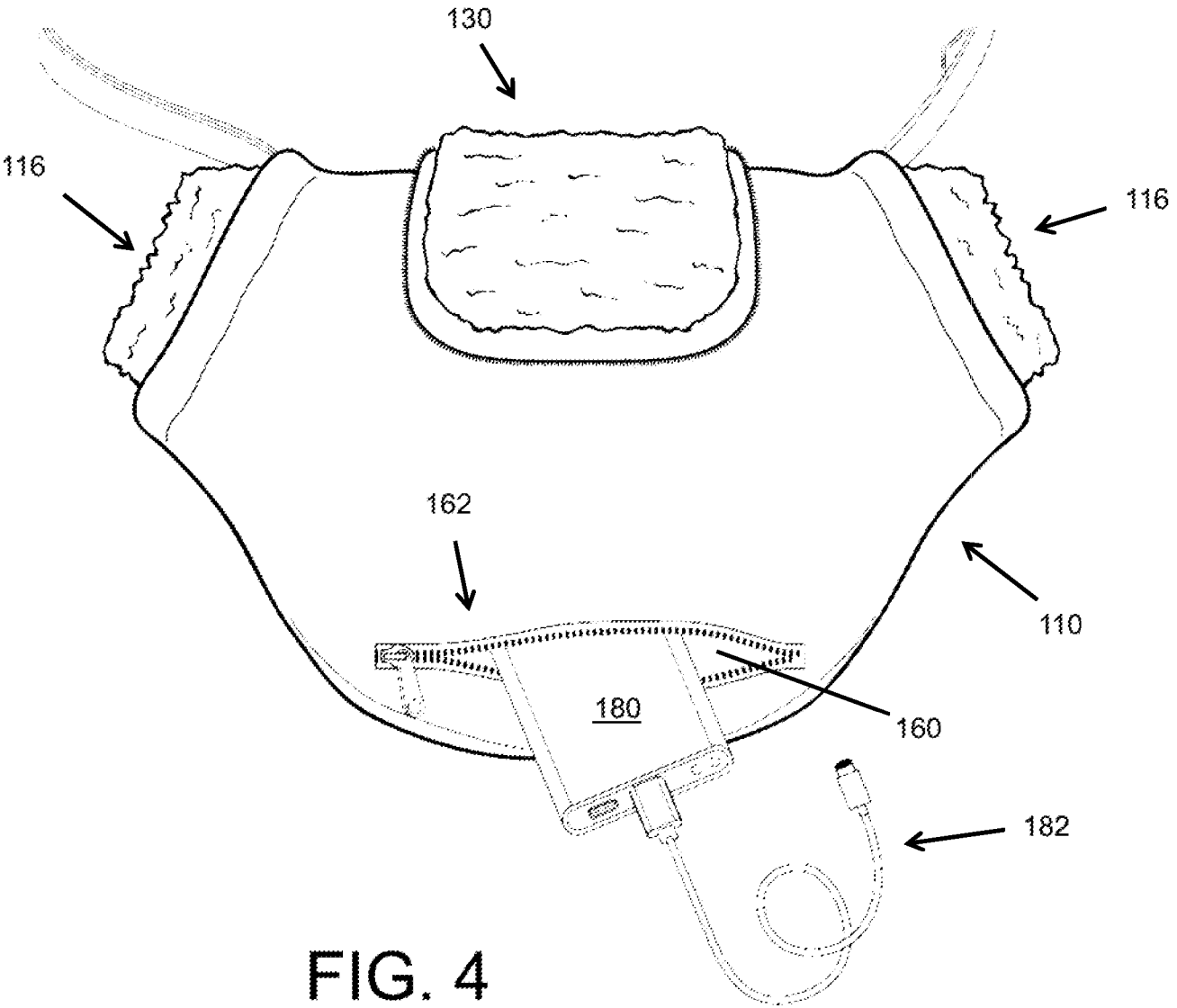
FIG. 4 illustrates a back view of a hand warmer showing a mobile device and pocket, according to an example.

FIG. 4 shows the backside of body 110 with compartment 160 and closure 162 in the open position. Also shown is a battery and charging cable for charging the electronic device used by the user, and located within the interior of body 110.

Figure 5:
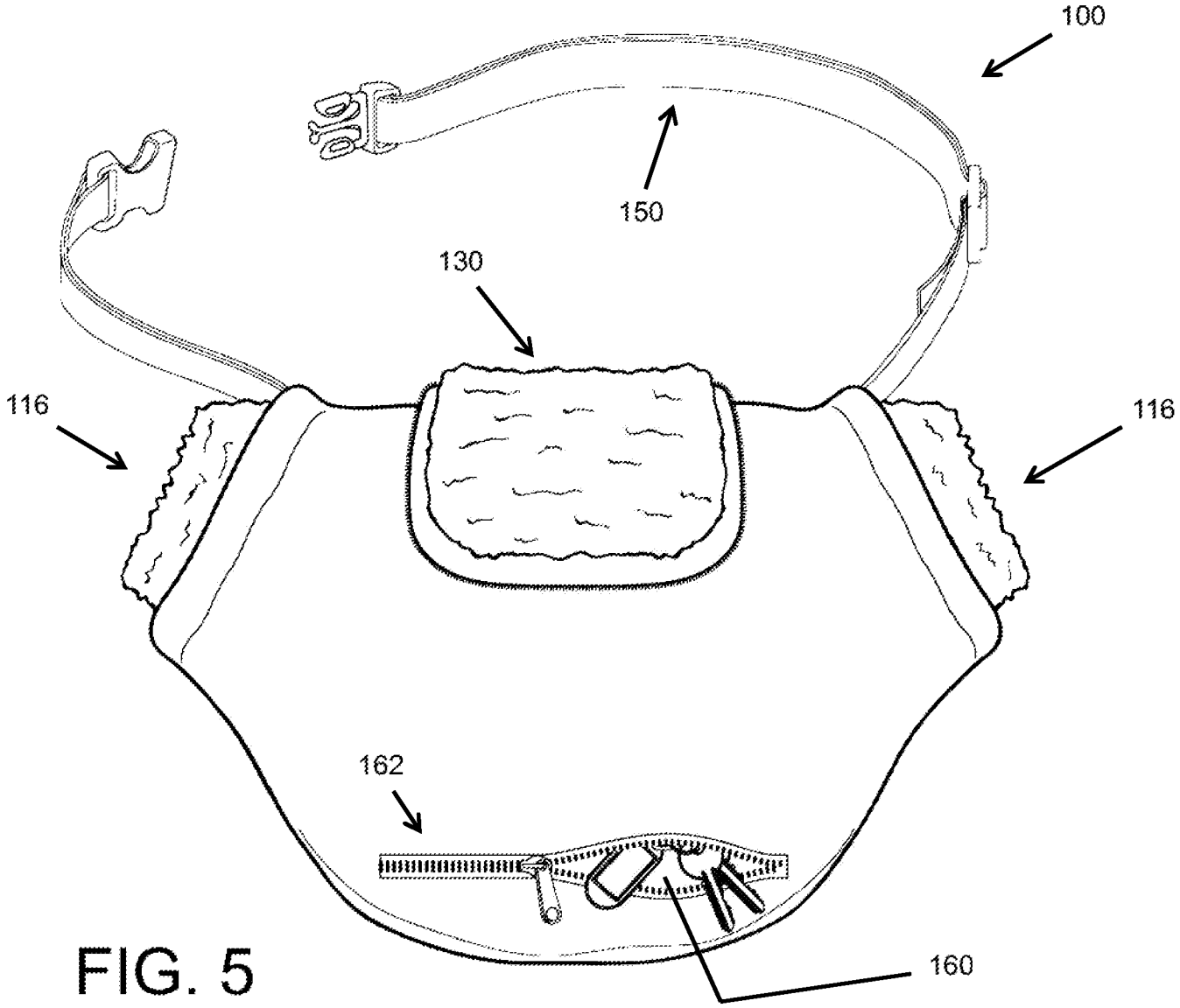
FIG. 5 illustrates a back view of a hand warmer, according to an example.

FIG. 5 shows the backside of body 110 with compartment 160 and closure 162 in the open position. Also shown is keys, which can be stored and secured within compartment 160. This may reduce the likelihood that the keys will get lost while the user is moving, hunting, etc.

Figure 6:
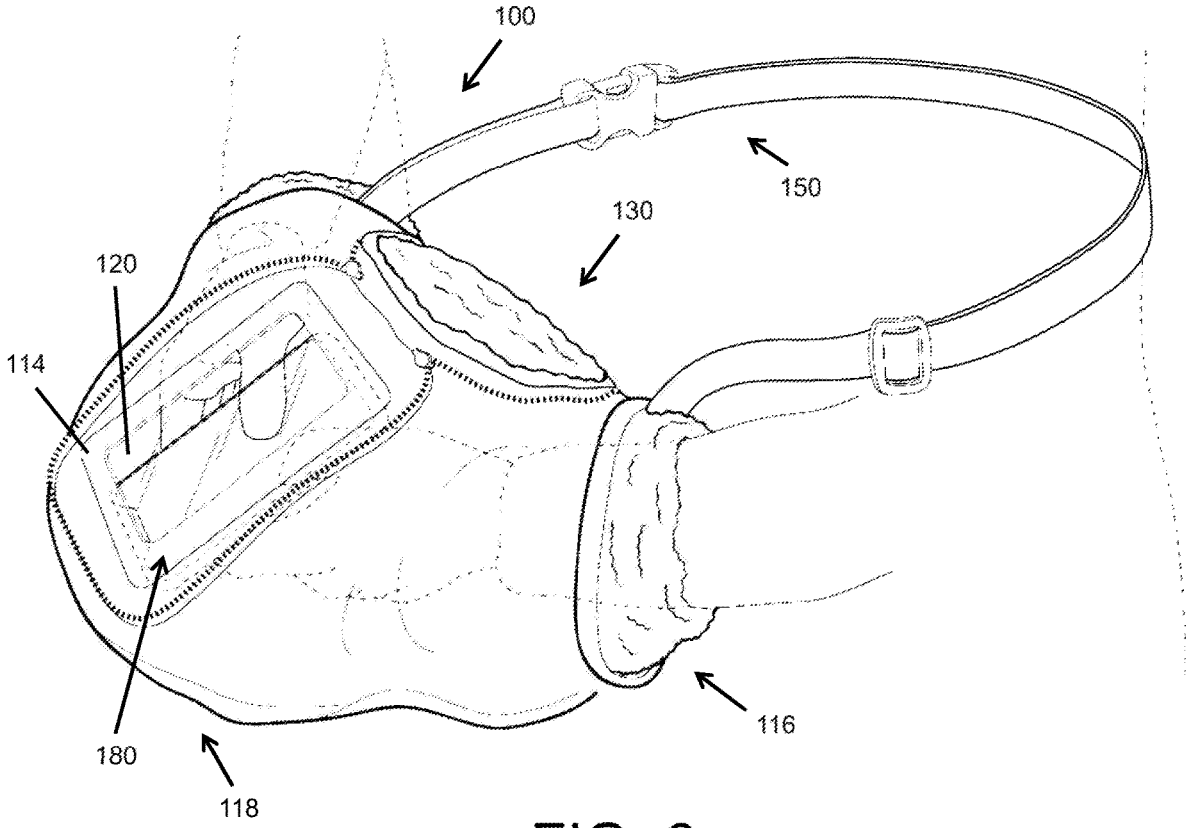
FIG. 6 illustrates a perspective view of a hand warmer with a mobile device being used by a user, according to an example.

FIG. 6 shows hand warmer 110 being used by a user, with the hands of the user extending through openings 116. The user may be capable of viewing the mobile or electronic device 180 through window 120 since cover 130 is secured in the open position.

Belt may be shown generally encircling the waist of the user to secure the hand warmer 100 to the user, and have the body 110 in a usable location and configuration.

Window 1220 may generally be configured to slide within stabilizer 114. Stabilizer 114 may be generally rigid, which holds or positions the body 110 and window 120 away from the hands of the user when using the electronic device 180. This may reduce rubbing and chafing of the hand warmer 100, body portion 110, and/or window 120 on any portion of the user, including the hands. This may increase the comfort and usability of the hand warmer 100 by the user.

Furthermore, body portion 110 may include a form stabilizer portion 118. Form stabilizer portion 118 may provide stability for body portion 110 such that when in use by a user, window 120, stabilizer portion 114, and body portion 110 generally do not touch or rest on the hands of a user. This configuration may make the hand warmer 100 more comfortable when in user, and may reduce chafing and rubbing of the hand warmer 100 on the hands or other portion of a user.

Figure 7:
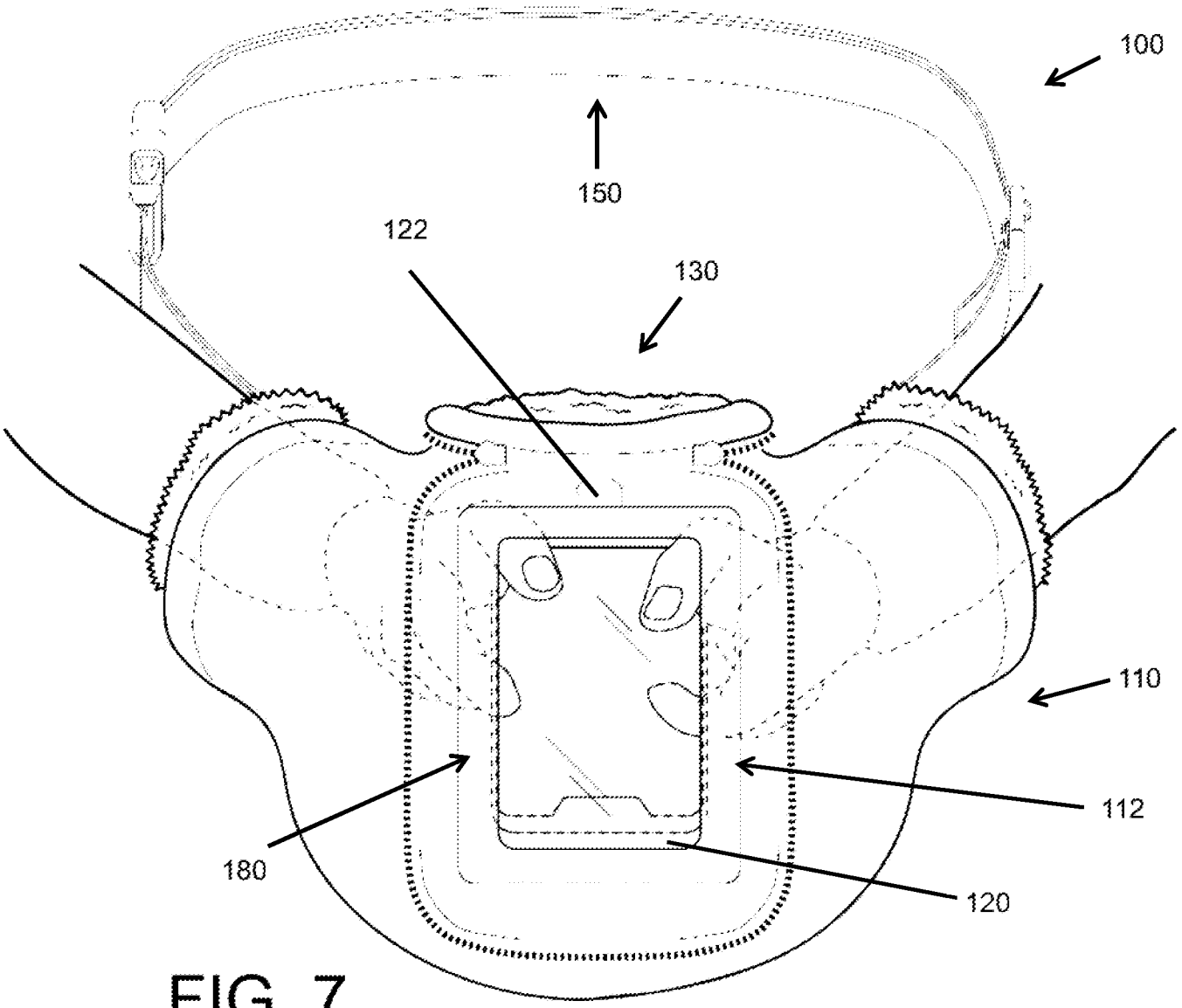
FIG. 7 illustrates a front view of a hand warmer with a mobile device being used by a user, according to an example.

FIG. 7 shows a front view of hand warmer 100 being used by a user with cover 130 in the open position. User can see through window 120 to be able to manipulate electronic device 180. Window 120 may include a tab 122, which may make it easier to user to selectably position window 120 within orifice 112. This may allow the opening of orifice 112 to allow defogging and to reduce condensation on window 120, or to allow external air into the interior of body 110 to cool off the interior, if desired.

Body portion 110 may include a device securing system, generally located on the back, interior of body portion, to secure the device within the interior of body portion, when the device is not in use. In an embodiment, the device securing system may include an elastic band coupled to a portion on the interior of the body portion 110.

Figure 8:
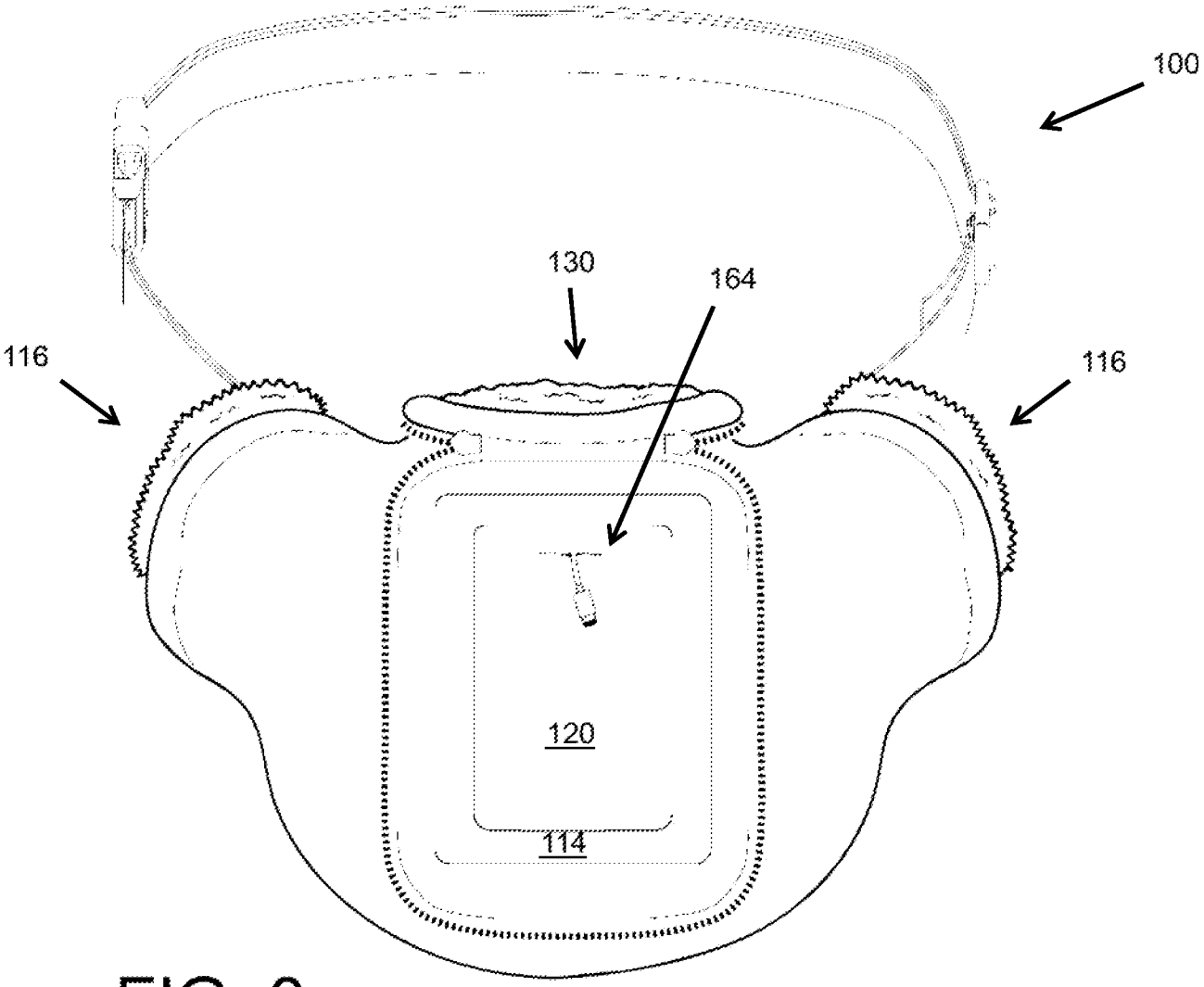
FIG. 8 illustrates a front view of a hand warmer showing an orifice used for a charging cable, through the window, according to an example.

FIG. 8 is a front view of hand warmer 100 with the cover 130 secured in the open position. Charging orifice 164 can be seen through window 120. Charging orifice 164 may be a passthough from compartment 160 into the interior of body portion 110. This will allow charging of a device 180 from a battery located in compartment 160 via a cable passing through orifice 164.

FIG. 9A shows a front view of warmer 100 with window 120 completely covering orifice 112, or otherwise in a completely closed position. Window 120 may include a tab 122 to enhance movement and positioning of window 120 within stabilizer 114.

FIG. 9A shows a front view of warmer 100 with window 120 partially covering orifice 112. This will allow outside air to enter into the interior of body portion 110 to reduce fog and condensation, and to cool off the interior of body portion 110.

Window 20 may become scratched or more opaque over time. This configuration allows window 120 to be completely removed, and replacement windows to be purchased and used when the user desires.

Figure 10A:
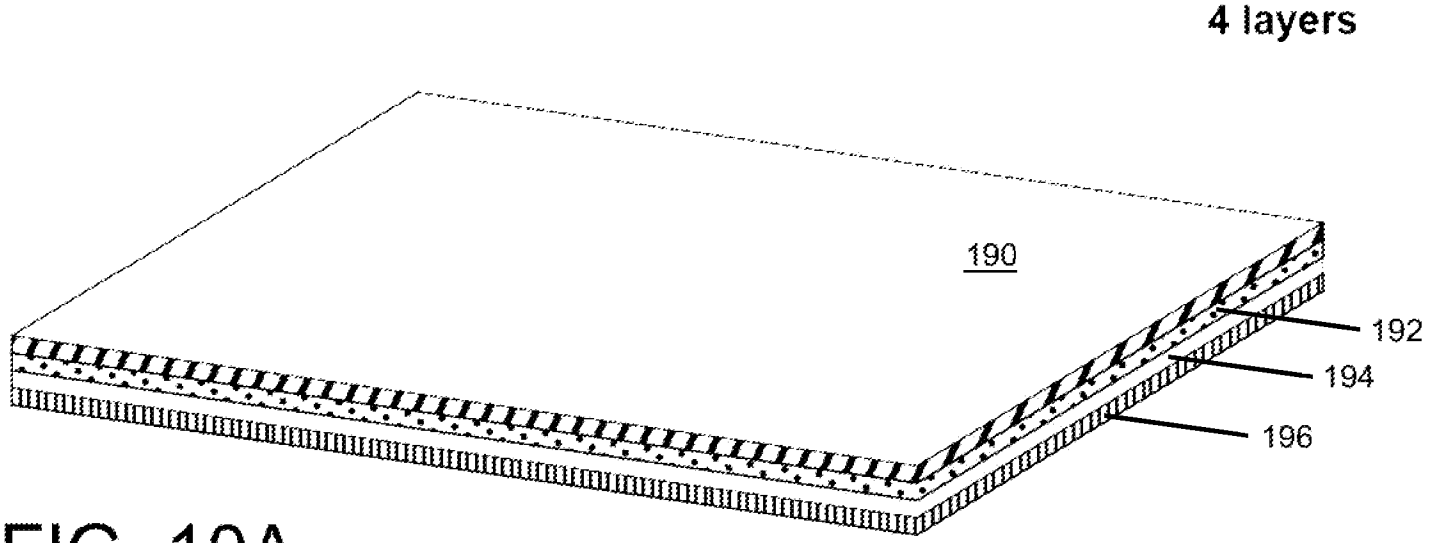
FIG. 10A illustrates a cross-section of materials used in a hand warmer, according to an example.
Figure 10B:
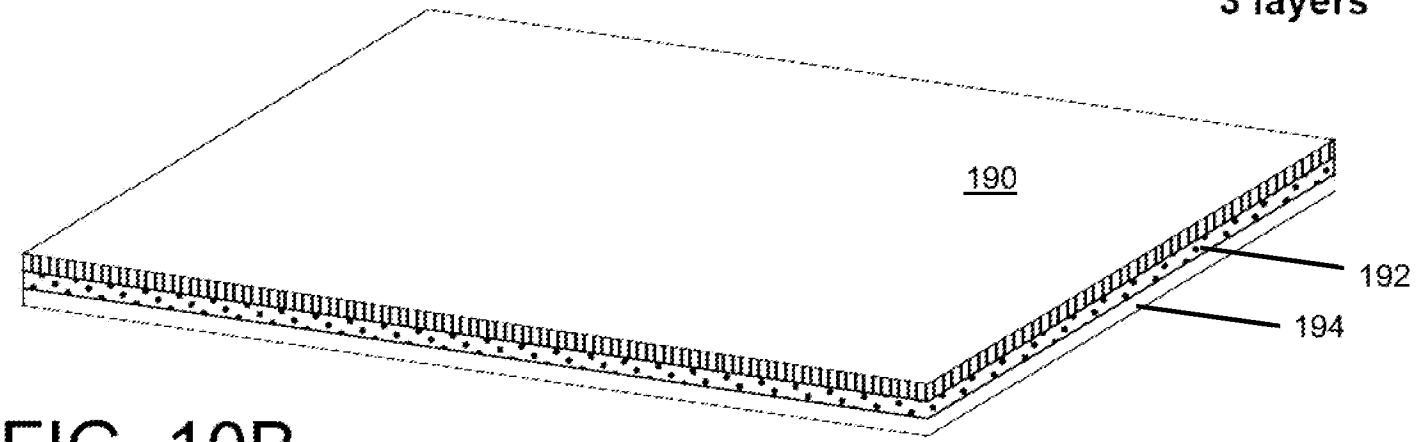
FIG. 10B illustrates a cross-section of materials used in a hand warmer, according to an example.

FIG. 10B shows a cross section of a three layer configuration of a portion of body portion 110. Layer 190 may be a generally pliable, soft, tear-resistant fabric, such as tricot. tricot is a very thin and smooth textured knit consisting of fine or single yarns which form vertical whales on the surface of the fabric and crosswise ribs on the back, thus resulting in a run-resistant knit. This may be soft and somewhat liquid resistant.

Layer 192 may include insulation such as Thinsulate® for insulation characteristics. Layer 194 may be another layer of tricot, thereby creating an insulation "sandwich" for comfort and heat transfer properties.

FIG. 10A shows a cross section of a four layer configuration of a portion of body portion 110. The embodiment of FIG. 10A is similar to that of FIG. 10B with the addition of a fleece layer 196. Fleece layer 196 may enhance the insulation properties, as well as the comfort of the hand warmer 100.

In the examples shown in FIGS. 10A and 10B, a generally solid water resistant membrane on the back side of the tricot 190. This prevents light rain from penetrating the tricot 190 and wetting the insulation 192. Membrane may be configured with thermoplastic polyurethane ("TPU"). Waterproof TPU fabrics may be used and bond a thermoplastic polyurethane membrane to a base textile, such as nylon, tricot, or polyester fabric, to create a wide range of high-performing materials that maintain their flexibility yet are durable and waterproof. TPU fabrics may be used as they maintain the base materials flexibility and softness, too.

Figure 11:
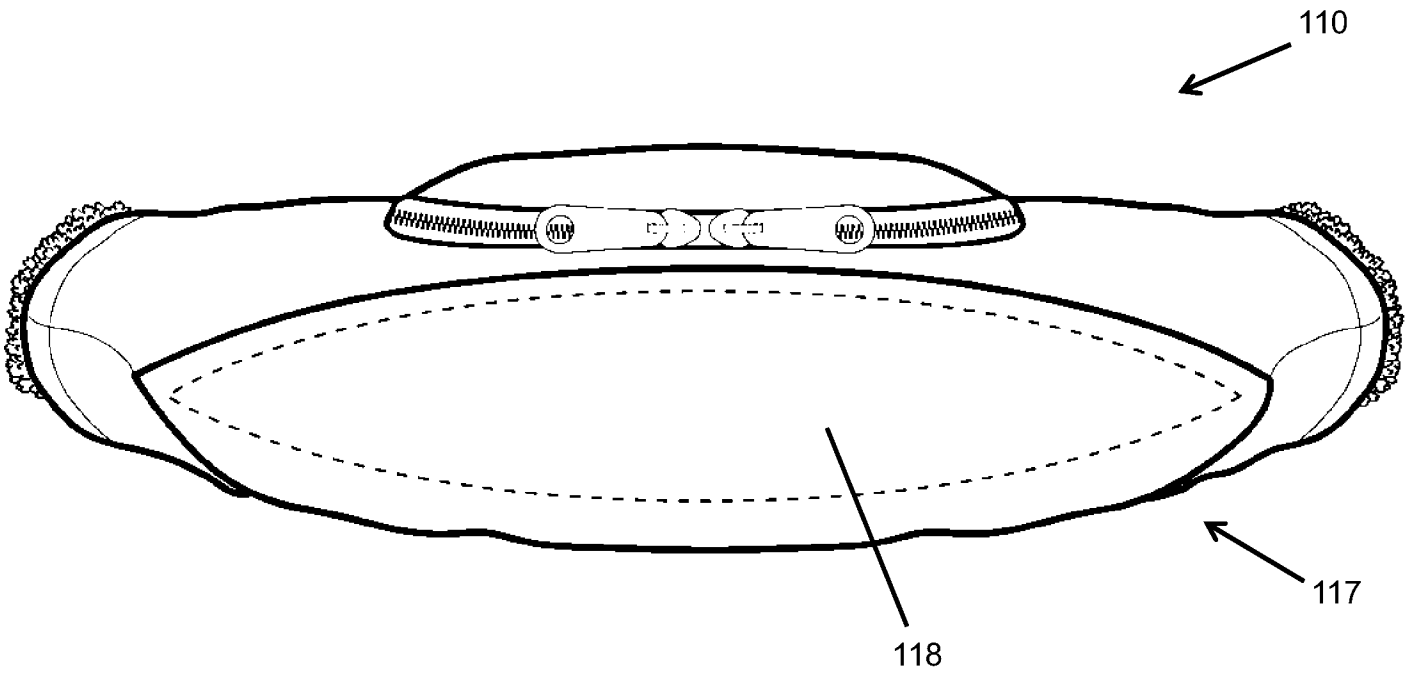
FIG. 11 illustrates a bottom view of a hand warmer showing the bottom portion of body portion, and a form stabilizer (in dashed lines), according to an example.

FIG. 11 is a bottom view of body portion 110, according to an embodiment. Body portion 110 includes a bottom portion 117, which may have a form stabilizer 118 within bottom portion 117. Stabilizer 118 may be located between layers of bottom portion 117. As shown stabilizer 118 is included beneath at least a first layer of bottom portion 117. Stabilizer may be included on the outside, inside, or between the various layers of body portion 110 in various locations to achieve the spacing and comfort to the user.

Figure 12:
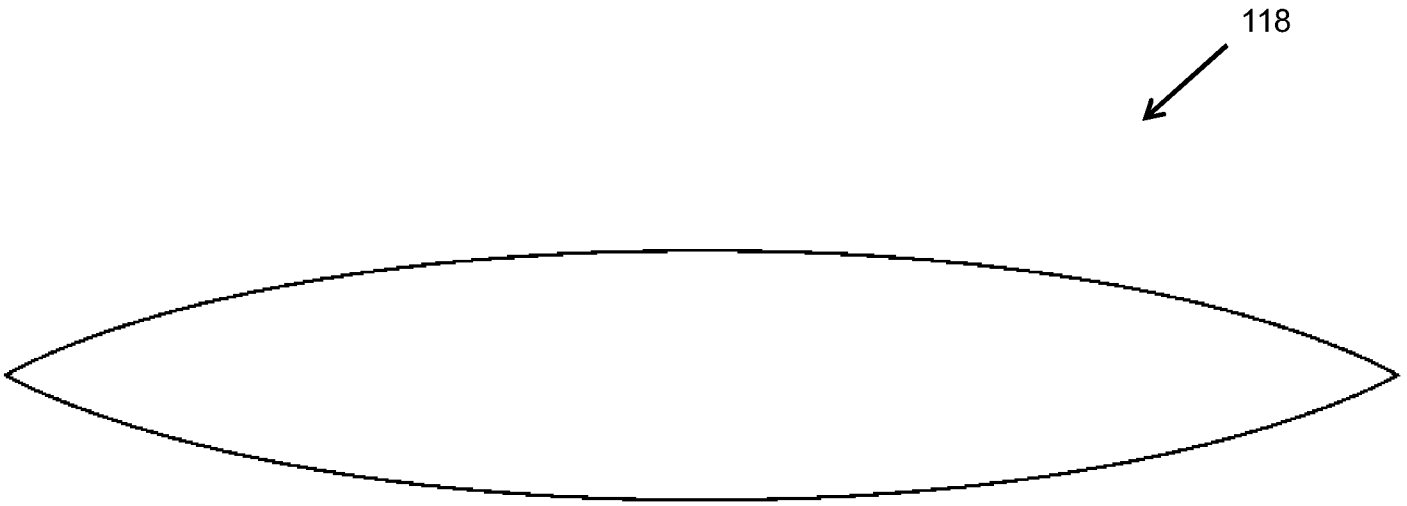
FIG. 12 illustrates a form stabilizer, according to an embodiment.

FIG. 12 shows a form stabilizer 118, according to an embodiment. Body portion 110 may also include a form stabilizer portion 118, located generally in the bottom portion 117 or any other portion of body portion 110. Form stabilizer portion 118 comprises generally rigid material, such as plastic or other rigid material, in a dual concave shape to create space between the front and back portions of body portion 110. It will be appreciated that other configurations for form stabilizer 118 may be used based on design and other configurations.

Form stabilizer portion 118 may provide stability for body portion 110 such that when in use by a user, window 120, stabilizer portion 114, and body portion 110 generally do not touch or rest on the hands of a user. This configuration may make the hand warmer 100 more comfortable when in user, and may reduce chafing and rubbing of the hand warmer 100 on the hands or other portion of a user. It will be appreciated that other deigns and configurations may be used for form stabilizer 118 without straying from the concepts and spirit and scope of this invention.

The previous description depicts specific examples of the invention to teach those skilled in the art how to make and use the invention. For the purpose of teaching inventive principles, some conventional aspects have been simplified or omitted. Those skilled in the art will appreciate variations from these embodiments that fall within the scope of the invention. Those skilled in the art will appreciate that the features described below can be combined in various ways to form multiple embodiments and variations of the invention. As a result, the invention is not limited to the specific embodiments described below, but only by the claims and their equivalents.

What is claimed is:

1. A hand warmer, comprising:

a body portion comprising:

one or more openings at opposite ends of the body portion configured to allow one or more hands of a user to extend therethrough into an interior of the body portion;

an orifice generally spaced between the one or more openings configured to receive a window portion that is transparent selectably removable and positionable, generally rigid wherein the window portion having a tab configured to allow the window portion be selectably removed and positioned to partially open the orifice, wherein the orifice and the window portion are configured to allow a user of the hand warmer to view a media device in the interior of the body portion;

a form stabilizer portion configured adjacent a bottom portion or a top portion of the body portion configured to minimize contact of the window portion and the body portion to the hands of a user;

a selectably positionable cover configured to extend over the orifice in a closed position, and to be secured away from the orifice in an open position;

wherein the window portion comprises a material configured to reduce fogging or condensation on the window portion, and a belt coupled to the body portion configured to generally encircle the waist of a user to selectably secure the hand warmer to a user.

2. The hand warmer of claim 1, wherein the body portion further comprises a cover securing system configured to secure the cover in an open position relative to the body portion.

3. The hand warmer of claim 1, wherein the body portion further comprises a fastener selectably configured to secure the cover in a closed position, and allow the cover to transition to an open position.

4. The hand warmer of claim 3, wherein the fastener comprises a slide-type fastener.

5. The hand warmer of claim 4, wherein the fastener comprises a zipper.

6. The hand warmer of claim 1, wherein the window portion comprises an anti-fog coating.

7. The hand warmer of claim 1, wherein the window portion is movable with respect to the orifice to allow opening or closing of the orifice.

8. The hand warmer of claim 1, wherein the window portion is completely removable with respect to the hand warmer.

9. The hand warmer of claim 1, wherein the body portion is configured to allow an electronic device to be in the interior of the body portion, and to be directly manipulated by a user while in the interior of the body portion.

10. A hand warmer comprising:

one or more openings at opposite ends of a body portion configured to allow one or more hands of a user to extend therethrough into an interior of the body portion;

an orifice generally spaced between the one or more openings configured to receive a window portion that is transparent selectably removable and positionable, generally rigid wherein the window portion having a tab configured to allow the window portion be selectably removed and positioned to partially open the orifice, wherein the orifice and the window portion are configured to allow a user of the hand warmer to view a media device in the interior of the body portion;

a form stabilizer portion configured within a top portion of the body portion configured to minimize contact of the window portion and the body portion to the hands of a user; and a selectably positionable cover configured to extend over the orifice in a closed position, and to be secured away from the orifice in an open position, wherein the window portion comprises a material or coating configured to reduce fogging or condensation on the window portion.

11. The hand warmer of claim 10, wherein the body portion is configured to allow an electronic device to be in the interior of the body portion, and to be directly manipulated by a user while in the interior of the body portion.

12. The hand warmer of claim 10, wherein the window portion is movable with respect to the orifice to allow opening or closing of the orifice.

13. The hand warmer of claim 10, wherein the body portion further comprises a fastener selectably configured to secure the cover in a closed position, and allow the cover to transition to an open position.

14. The hand warmer of claim 10, wherein the hand warmer is configured to couple the hand warmer to a user.

15. A hand warmer comprising:

one or more openings at opposite ends of a body portion configured to allow one or more hands of a user to extend therethrough into an interior of the body portion;

an orifice generally spaced between the one or more openings configured to receive a window portion that is transparent selectably removable and positionable, generally rigid wherein the window portion having a tab configured to allow the window portion be selectably removed and positioned to partially open the orifice, wherein the orifice and the window portion are configured to allow a user of the hand warmer to view a media device in the interior of the body portion;

a form stabilizer portion configured within a bottom portion and a top portion of the body portion configured to minimize contact of the window portion and the body portion to the hands of a user; and a selectably positionable cover configured to extend over the orifice in a closed position, and to be secured away from the orifice in an open position, wherein the window portion comprises a material or coating configured to reduce fogging or condensation on the window portion, wherein the body portion is configured to allow an electronic device to be in the interior of the body portion, and to be directly manipulated by a user while in the interior of the body portion, wherein the window portion is movable with respect to the orifice to allow opening or closing of the orifice, wherein the hand warmer is configured to couple the hand warmer to a user.

16. The hand warmer of claim 1, wherein the body portion further comprises a cover securing system configured to secure the cover in an open position relative to the body portion.

17. The hand warmer of claim 1, wherein the body portion further comprises a fastener selectably configured to secure the cover in a closed position, and allow the cover to transition to an open position.

* * * * *